US006227954B1

(12) United States Patent
Togawa et al.

(10) Patent No.: US 6,227,954 B1
(45) **Date of Patent: *May 8, 2001**

(54) POLISHING APPARATUS

(75) Inventors: Tetsuji Togawa, Chigasaki; Kuniaki Yamaguchi, Yokohama; Kunihiko Sakurai, Yokohama; Hiromi Yajima, Yokohama, all of (JP)

(73) Assignees: Ebara Corporation, Tokyo; Kabushiki Kaisha Toshiba, Kanagawa-Ken, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/845,423

(22) Filed: Apr. 25, 1997

(30) Foreign Application Priority Data

Apr. 26, 1996 (JP) ..... 8-130987
May 28, 1996 (JP) ..... 8-157608

(51) Int. Cl.[7] ..... B24B 7/00

(52) U.S. Cl. ..... 451/285; 451/288; 451/443; 451/451; 451/287

(58) Field of Search ..... 451/41, 285, 287, 451/288, 56, 54, 443, 444, 451

(56) References Cited

U.S. PATENT DOCUMENTS

| | | | | |
|---|---|---|---|---|
| 5,036,625 | | 8/1991 | Gosis . | |
| 5,333,413 | * | 8/1994 | Hashimoto | 451/287 |
| 5,616,063 | | 4/1997 | Okumura et al. . | |
| 5,655,954 | * | 8/1997 | Oishi et al. | 451/287 |
| 5,679,055 | * | 10/1997 | Greene et al. | 451/41 |
| 5,679,060 | * | 10/1997 | Leonard et al. | 451/41 |
| 5,733,171 | * | 3/1998 | Allen et al. | 451/41 |
| 5,779,520 | * | 7/1998 | Hayakawa | 451/288 |

FOREIGN PATENT DOCUMENTS

| | | |
|---|---|---|
| 195 44 328 | 5/1996 | (DE) . |
| 63-207559 | 8/1988 | (JP) . |

OTHER PUBLICATIONS

Copending U.S. Patent Application filed Jan. 23, 1997, entitled "Polishing Apparatus", by Tetsuji Togawa et al., Serial No. 08/787,916, Attorney Docket No. 1213/GEB434US, Group Art Unit 1104.

Co–pending U.S. application Serial No. 08/563,295, filed Nov. 28, 1995, "Polishing Apparatus and Method", Toyomi Nishi et al., scheduled to issue Oct. 21, 1997 as U.S. Patent No. 5,679,059.

Co–pending U.S. application Serial No. 08/580,312, filed Dec. 28, 1995, "Polishing Facility", Hiromi Yajima et al., located in Group Art Unit 3203.

* cited by examiner

*Primary Examiner*—Eileen P. Morgan
(74) *Attorney, Agent, or Firm*—Wenderoth, Lind & Ponack, L.L.P.

(57) ABSTRACT

A polishing apparatus includes a top ring for holding a workpiece to be polished on a lower surface thereof, a turntable having a polishing surface for polishing a surface of the workpiece held by the top ring, and a dressing tool for dressing the polishing surface of the turntable. The top ring is movable to a first maintenance position therefor, and the dressing tool is movable to a second maintenance position therefor. The top ring, the turntable, and the dressing tool are housed in a single chamber having a plurality of side faces. The polishing surface, the first maintenance position, and the second maintenance position are positioned closely to one of the side faces of the chamber. Such one side face serves as a maintenance face for approaching the polishing surface, the first maintenance position, and the second maintenance position for maintenance of the polishing surface, the top ring and the dressing tool.

14 Claims, 7 Drawing Sheets

POLISHING APPARATUS

BACKGROUND OF THE INVENTION

1. Field of the Invention

The present invention relates to a polishing apparatus for polishing a workpiece such as a semiconductor wafer to a flat mirror finish, and more particularly to a polishing apparatus having an easy maintenance characteristic.

2. Description of the Related Art

Recent rapid progress in semiconductor device integration demands smaller and smaller wiring patterns or interconnections and also narrower spaces between interconnections which connect active areas. One of the processes available for forming such interconnections is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus, and such a process is called Chemical Mechanical polishing.

FIG. 7 shows one conventional polishing apparatus having a polishing section 100 for polishing semiconductor wafers. The polishing section 100 comprises a turntable 110 having a polishing surface 111 and rotatable about its own axis at a predetermined speed, a top ring 120 for holding a semiconductor wafer to rotate the semiconductor wafer at a predetermined speed and pressing the semiconductor wafer against the polishing surface 111 of the turntable 110 for thereby polishing a surface of the semiconductor wafer, and a dressing tool 130 for dressing the polishing surface 111 to regenerate the polishing surface in contact therewith. The turntable 110, the top ring 120, and the dressing tool 130 are housed in a single chamber 101.

The polishing apparatus also has a cleaning section 140 for conveying the semiconductor wafers and cleaning the semiconductor wafers. The cleaning section 140 comprises two workpiece conveying robots 151, 153 for taking a semiconductor wafer out of a cassette and delivering the semiconductor wafer to the polishing section 100, primary and secondary cleaning devices 161, 163 for cleaning the semiconductor wafer which has been polished, a drying device 170 for drying the semiconductor wafer which has been cleaned, and two workpiece reversing devices 181, 183 for reversing the semiconductor wafer upside down. The workpiece conveying robots 151, 153, the primary and secondary cleaning devices 161, 163, the drying device 170, and the workpiece reversing devices 181, 183 are housed in a single chamber 141.

Certain parts of the top ring 120, a polishing cloth which provides the polishing surface 111 of the turntable 110, and a dressing element such as a dresser brush or a diamond grain layer on the dressing tool 130 are expendable articles or parts that should be replaced with new ones periodically by maintenance operations.

The cleaning devices 161, 163 also have expendable articles including cleaning brushes and sponge elements which are also required to be replaced with new ones periodically by maintenance operations.

The above maintenance operations are not and do not signify service repair activities for repairing the polishing section 100 and the cleaning section 140 in the event of malfunctions or failures, but periodical replacement routines for replacing expendable articles or parts.

Heretofore, the maintenance operations or activities which involve parts replacement have been carried out at three different side faces of the apparatus, i.e., a side face "a" for maintenance such as replacement of the parts of the top ring 120, a side face "b" for maintenance such as replacement of the polishing cloth constituting the polishing surface 111, and a side face "c" for maintenance such as replacement of the dresser brush of the dressing tool 130 and the cleaning brushes of the cleaning devices 161, 163.

Because of these three side faces "a", "b" and "c" involved, it has been necessary to provide respective empty spaces in front of the side faces "a", "b" and "c" to allow approach and access to the side faces "a", "b" and "c" for maintenance such as the replacement of parts. Consequently, any one of these side faces "a", "b" and "c" cannot be positioned closely to other hindering objects such as walls or pillars, with the result that a large installation space has been required for the installation of the polishing apparatus.

When the polishing apparatus is to be maintained or serviced successively at the side faces "a", "b" and "c", the maintenance operator has to move from one side face to another while carrying tools and parts. Therefore, maintenance of the polishing apparatus has been troublesome and time-consuming.

FIG. 8 is a perspective view showing an outer appearance of the conventional polishing apparatus shown in FIG. 7. As shown in FIG. 8, the polishing section 100 and the cleaning section 140 are housed in respective chambers in the form of rectangular parallelepipeds.

The polishing section 100 and the cleaning section 140 have a number of pipes 171, 181 extending from side walls of the chambers for supplying liquid to and discharging liquid from the various units and machines in the polishing section 100 and the cleaning section 140. The pipes 171, 181 extend vertically through a floor 180 into a machinery room (not shown) below the floor 180, and are connected to various devices in the machinery room.

Heretofore, the pipes 171, 181 projecting out of the chambers are randomly located, and cause various problems described below.

Since the pipes 171, 181 project from the side walls of the chambers, they present obstacles when the polishing section 100 and the cleaning section 140 are maintained, or transported for installation thereof. When the pipes 171, 181 are damaged or broken by collision with operators or other objects, they give rise to safety problems.

The operation of installation of the polishing apparatus on the floor 180 is troublesome and time-consuming because the floor 180 has to be drilled to make holes for insertion of the pipes 171, 181.

The pipes 171, 181 project from the side walls of the chambers into passages around the chambers and tend to obstruct operators walking along the passages. Therefore, the pipes 171, 181 cause the polishing apparatus to take up a greater installation space than would be required by their physical size. In addition, the pipes 171, 181 are not sightly to external view.

SUMMARY OF THE INVENTION

It is therefore an object of the present invention to provide a polishing apparatus which allows a maintenance operator to easily perform maintenance activities such as replacement of various expendable articles or parts, and which can be installed in a relatively small installation space.

Another object of the present invention is to provide a polishing apparatus which can be easily maintained, transported and installed, does not obstruct operators walking along passages therearound, and is sightly to external view.

According to one aspect of the present invention, there is provided a polishing apparatus for polishing a surface of a workpiece comprising: a turntable having a polishing surface; a top ring for holding a workpiece and pressing the workpiece against the polishing surface of the turntable to polish the workpiece, the top ring being movable to a first maintenance position therefor; and a dressing tool for dressing the polishing surface of the turntable, the dressing tool being movable to a second maintenance position therefor. The top ring, the polishing surface of the turntable, and the dressing tool are housed in a first chamber having a plurality of side faces, and the polishing surface, the first maintenance position and the second maintenance position are positioned closely to one of the side faces. The one of the side faces serves as a first maintenance face for approaching the polishing surface, the first maintenance position and the second maintenance position for maintenance of the polishing surface, said top ring and the dressing tool.

According to another aspect of the present invention, there is provided a polishing apparatus for polishing a surface of a workpiece comprising: a polishing section housed in a first chamber for polishing a surface of a workpiece; and a cleaning section housed in a second chamber for cleaning the workpiece which has been polished, the first chamber having a first side face and the second chamber having a second side face joined to the first side face, the second side face being longer than the first side face to define an exposed portion which does not face the first side face. The first and second chambers jointly define a space in front of the exposed portion and alongside of another side face of the first chamber. The polishing section and the cleaning section have pipes extending from the exposed portion of the second side face and the other side face of the first chamber into the space, respectively.

The above and other objects, features, and advantages of the present invention will become apparent from the following description when taken in conjunction with the accompanying drawings which illustrate preferred embodiments of the present invention by way of examples.

DETAILED DESCRIPTION OF THE PREFERRED EMBODIMENT

A polishing apparatus according to a first embodiment of the present invention will be described below with reference to FIGS. 1 and 2.

Figure 1:
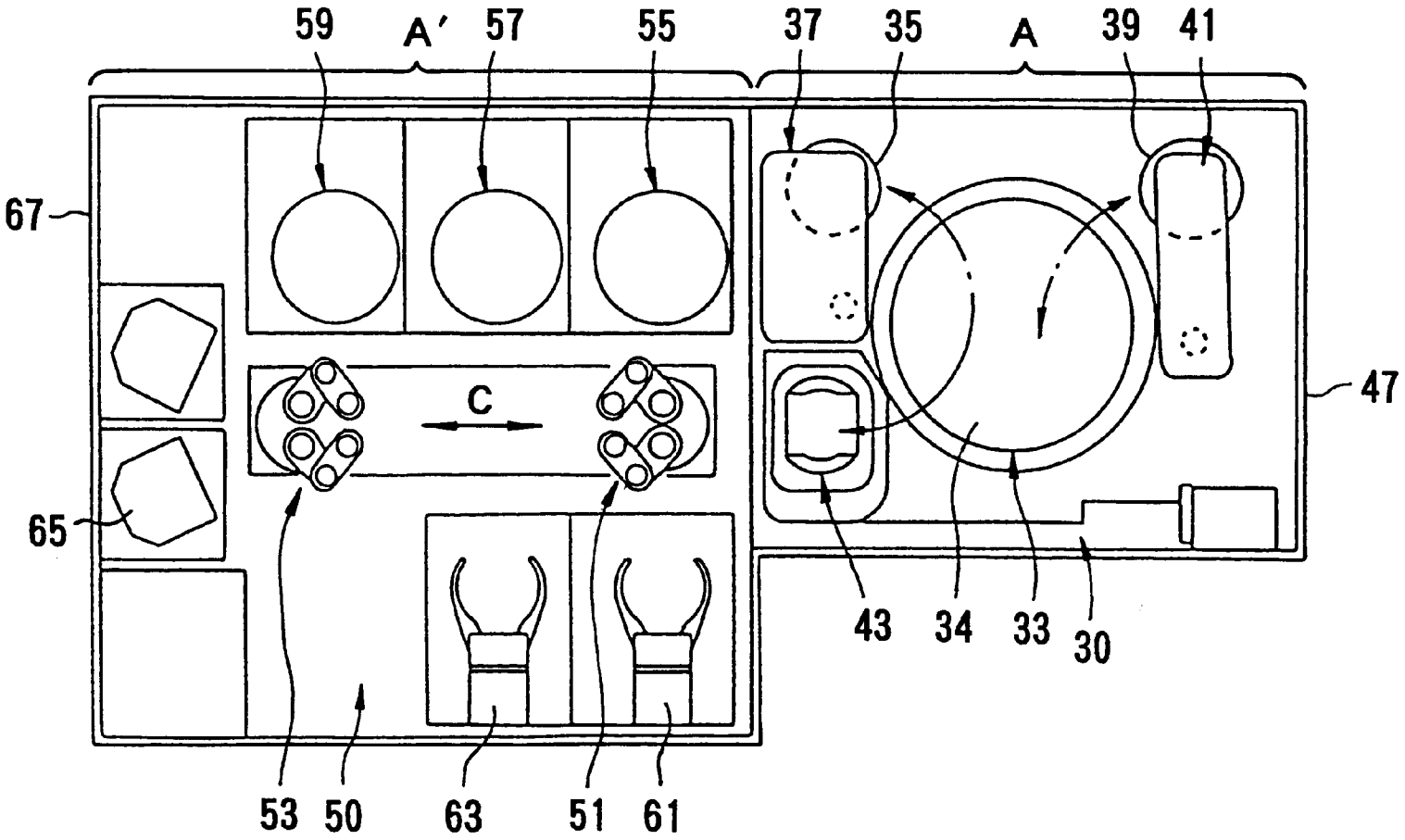
FIG. 1 is a schematic plan view of a polishing apparatus according to a first embodiment of the present invention.

As shown in FIG. 1, a polishing apparatus comprises a polishing section 30 for polishing a workpiece such as a semiconductor wafer, and a cleaning section 50 for cleaning the workpiece which has been polished in the polishing section 30. The polishing section 30 comprises a central turntable 33, a polishing unit 37 disposed on one side of the turntable 33 and having a top ring 35, a dressing unit 41 disposed on the other side of the turntable 33 and having a dressing tool 39, and a workpiece transfer device 43 for transferring the workpiece between the top ring 35 and the workpiece transfer device 43. The turntable 33, the polishing unit 37, the dressing unit 41, and the workpiece transfer unit 43 are all housed in a single chamber 47 which is enclosed by walls.

In FIG. 1, the top ring 35 is shown as being in a maintenance position therefor, and the dressing tool 39 is also shown as being in a maintenance position therefor. When the top ring 35 and the dressing tool 39 are in their respective maintenance positions, they are positioned closely to a side face A of the polishing section 30. The polishing surface 34 of the turntable 33 is also positioned closely to the side face A.

In the illustrated embodiment, only the side face A of the polishing section 30, among a plurality of side faces of the chamber 47, serves as a maintenance face which is easily approachable for maintenance of the polishing section 30. A door (not shown) for maintenance is provided at the side face A.

The cleaning section 50 comprises a pair of central workpiece conveying robots 51, 53 movable in the directions indicated by the arrow C, primary and secondary cleaning devices 55, 57 and a spinning drier 59 which are arranged in an array on one side of the workpiece conveying robots 51, 53, and two workpiece reversing devices 61, 63 which are arranged in an array on the other side of the workpiece conveying robots 51, 53. The workpiece conveying robots 51, 53, the primary and secondary cleaning devices 55, 57 and the spinning drier 59, and the workpiece reversing devices 61, 63 are housed in a single chamber 67 which is enclosed by walls.

The primary and secondary cleaning devices 55, 57 and the spinning drier 59 are positioned closely to a side face A' of the cleaning section 50. In the illustrated embodiment, only the side face A' of the cleaning section 50, among a plurality of side faces of the chamber 67, serves as a maintenance face which is easily approachable for maintenance of the cleaning section 50. A door (not shown) for maintenance is provided at the side face A'. The side face A' of the cleaning section 50 is aligned with or lies flush with the side face A of the polishing apparatus 30. That is, the polishing section 30 and the cleaning section 50 have a common side face comprising the side faces A and A' for approaching interiors thereof for maintenance of the polishing section 30 and the cleaning section 50.

Figure 2:
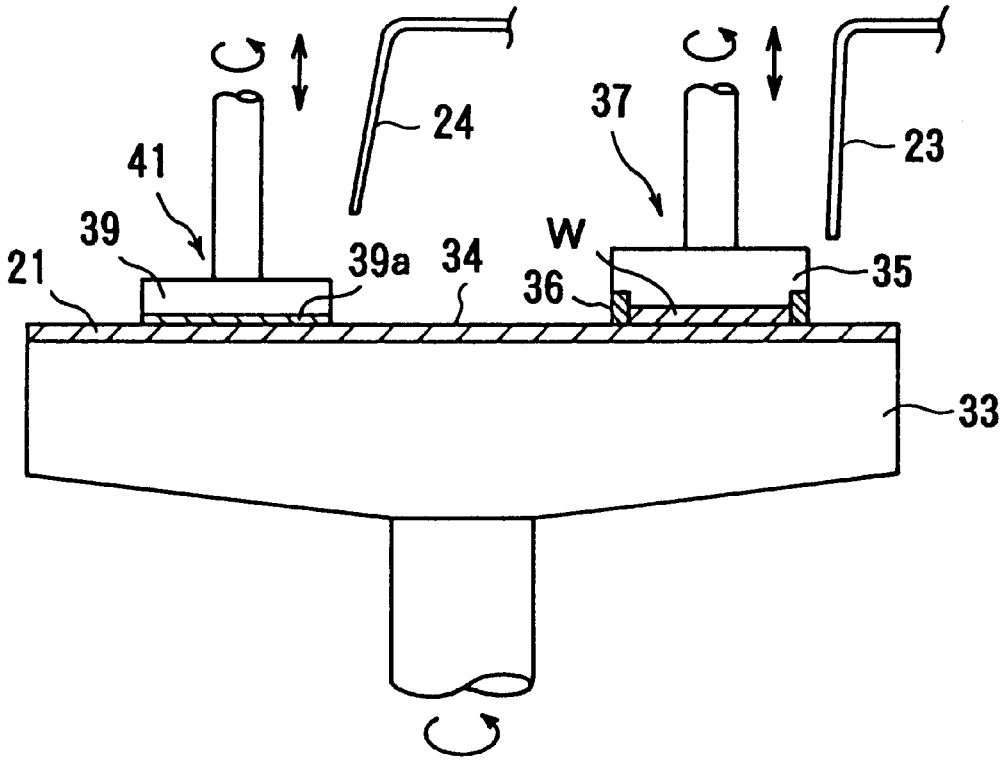
FIG. 2 is a cross-sectional view of a polishing section of the polishing apparatus.

FIG. 2 shows the polishing section 30 having the turntable 33, the polishing unit 37 and the dressing unit 41. The polish unit 37 has the top ring 35 for supporting a semiconductor wafer W and pressing the semiconductor wafer W against the turntable 33. The turntable 33 is rotatable about its own axis as indicated by an arrow by a motor (not shown) which is coupled to the turntable 33. A polishing cloth 21 constituting a polishing surface 34 is attached to an upper surface of the turntable 33.

The top ring 35 is coupled to a motor (not shown) and also to a lifting/lowering cylinder (not shown). The top ring 35 is vertically movable and rotatable about its own axis as indicated by the arrows by the motor and the lifting/lowering cylinder. The top ring 35 can therefore press the semiconductor wafer W against the polishing cloth 21 under a desired pressure. The semiconductor wafer W is attached to a lower surface of the top ring 35 under a vacuum or the like. A guide ring 36 is mounted on the outer circumferential edge of the lower surface of the top ring 35 for preventing the semiconductor wafer W from being disengaged from the top ring 35. An abrasive liquid is supplied through a supply pipe 23 onto the polishing cloth 21.

Dressing unit 41 comprises dressing tool 39 which is positioned above the turntable 33 in diametrically opposite relation to the top ring 35. A dressing liquid is supplied through a supply pipe 24 onto the polishing cloth 21. The dressing tool 39 is coupled to a motor (not shown) and also to a lifting/lowering cylinder (not shown). The dressing tool 39 is vertically movable and rotatable about its own axis as indicated by the arrows by the motor and the lifting/lowering cylinder. The dressing tool 39 has a dressing element 39*a* composed of, for example, nylon brush, or a diamond grain layer containing diamond grains on its lower surface.

Operation of the polishing apparatus comprising the polishing section 30 and the cleaning section 50 will be described below.

When a wafer cassette 65 which houses a plurality of semiconductor wafers to be polished is set in a position as shown in FIG. 1, the workpiece conveying robot 53 takes a semiconductor wafer out of the cassette 65, and transfers the semiconductor wafer to the workpiece reversing device 63. After the semiconductor wafer is reversed, i.e., turned upside down, by the workpiece reversing device 63, it is received by the workpiece conveying robot 51, and then placed onto the workpiece transfer device 43 through an opening formed in a partition between chambers by the workpiece conveying robot 51.

Thereafter, the top ring 35 of the polishing unit 37 is angularly displaced as indicated by the dot-and-dash line to a position directly above the workpiece transfer device 43. The semiconductor wafer on the workpiece transfer device 43 is lifted to a position near a lower surface of the top ring 35, and then attached to the top ring 35 under vacuum developed by a vacuum pump or the like (not shown).

Then, the top ring 35 is moved over the turntable 33, and presses the semiconductor wafer against the polishing surface 34 on the turntable 33. While the turntable 33 and the top ring 35 are rotated independently of each other, the lower surface of the semiconductor wafer is polished to a flat mirror finish. At this time, the abrasive liquid is supplied through the supply pipe 23 onto the polishing surface 34. After the semiconductor wafer is polished, the top ring 35 is moved back over the workpiece transfer device 43, and transfers the polished semiconductor wafer onto the workpiece transfer device 43.

The semiconductor wafer placed on the workpiece transfer device 43 is then held by the workpiece conveying robot 51, and transferred therefrom to the workpiece reversing device 61. The workpiece reversing device 61 reverses the semiconductor wafer. The reversed semiconductor wafer is transferred successively to the primary and secondary cleaning devices 55 and 57, and the spinning drier 59, whereby the semiconductor wafer is cleaned by cleaning liquid such as pure water and dried. The spinning drier 59 may have a function of cleaning and drying. The cleaned and dried semiconductor wafer is finally returned to the cassette 65 by the workpiece conveying robot 53.

After the semiconductor wafer is polished, the dressing tool 39 of the dressing unit 41 is angularly moved over the turntable 33 as indicated by the dot-and-dash-line arrow, and then presses the dressing tool 39 against the polishing surface 34 for thereby dressing the polishing surface 34. At this time, pure water is supplied as dressing liquid through the supply pipe 24 onto the polishing surface 34.

Parts of a mechanism on the top ring 35 for holding the semiconductor wafer, the dresser element and other parts on the dressing tool 39 are expendable parts. These expendable parts of the top ring 35 and the dressing tool 39 are replaced with new parts while the top ring 35 and the dressing tool 39 are in their respective maintenance positions shown in FIG. 1. Since these maintenance positions are located closely to the side face A, the parts can easily be replaced from the side face A while the maintenance door is open.

The polishing cloth 21 which provides the polishing surface 34 of the turntable 33 is also an expendable part and can easily be replaced by the maintenance operator from the side face A while the maintenance door is open.

Cleaning brushes, sponge elements, and other parts of the primary and secondary cleaning devices 55, 57, and parts of the spinning drier 59 are also expendable parts, and can easily be replaced from the side face A' while the maintenance door is open.

As described above, the first embodiment of the present invention offers the following advantages:

Since the side faces A and A' are aligned or lie flush with each other, the maintenance operator is not required to move a large distance but a short distance from one of the side faces A, A' to the other, while carrying tools and parts, when a plurality of parts units or machines are to be maintained for parts replacement. Therefore, the maintenance operator finds it easy to replace plural expendable parts.

The faces other side than the side faces A and A' of the polishing apparatus comprising the polishing section 30 and the cleaning section 50 may be positioned closely to hindering objects such as walls or pillars. As a consequence, the installation space required to install the polishing apparatus therein may be relatively small in size.

Next, a polishing apparatus according to a second embodiment of the present invention will be described below with reference to FIGS. 3 through 6. In FIGS. 3 through 6, the parts which are structurally or functionally identical to the parts shown in FIGS. 1 and 2 are represented by the same reference numerals.

The structure of the polishing section 30 and the cleaning section 50 in the second embodiment is identical to that of the polishing section 30 and the cleaning section 50 in the first embodiment.

Figure 3:
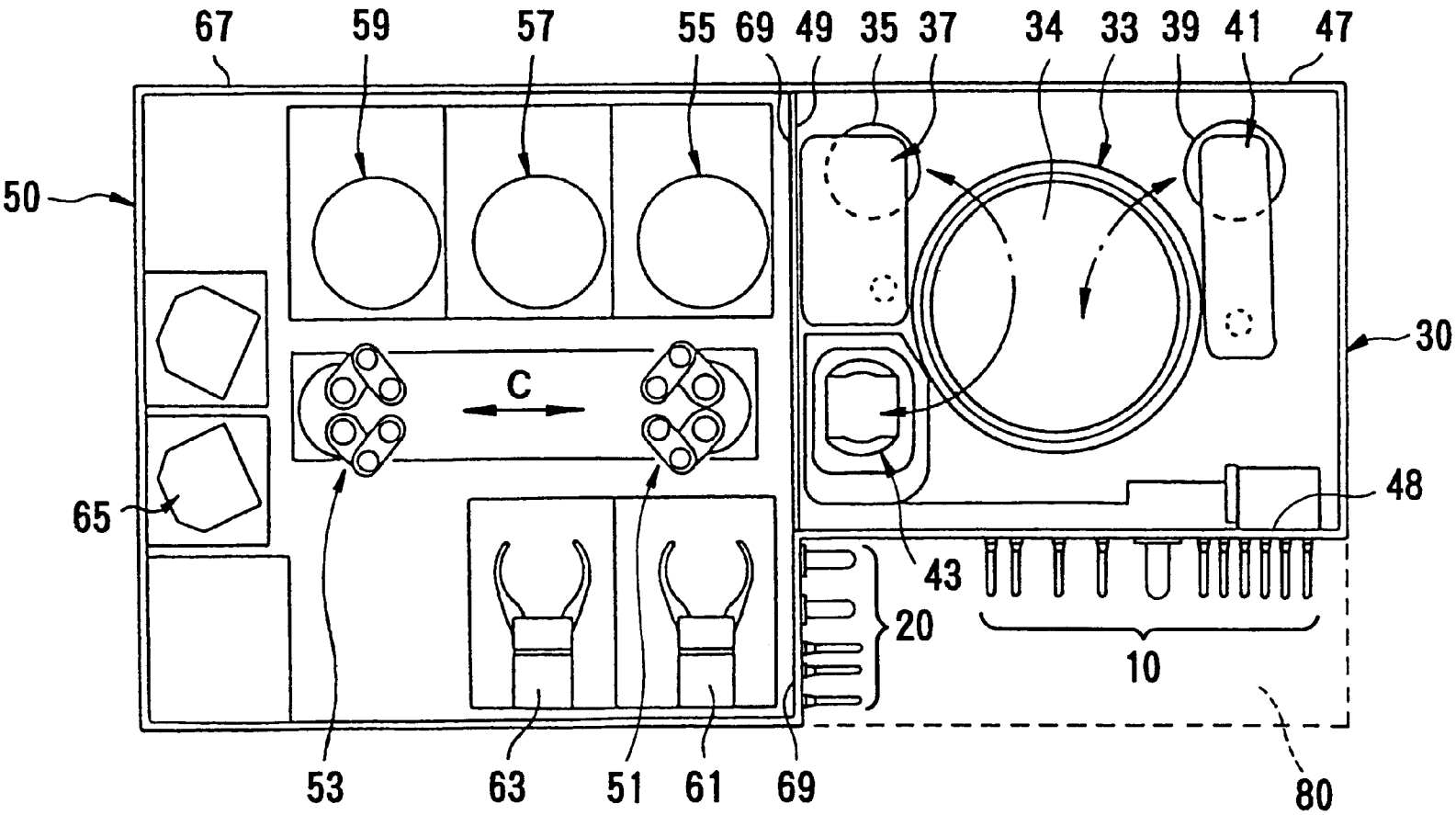
FIG. 3 is a schematic plan view of a polishing apparatus according to a second embodiment of the present invention.

As shown in FIG. 3, in this embodiment, the chambers 47 and 67 which accommodate the various units and machines of the polishing section 30 and cleaning section 50 have respective side faces 49 and 69 joined to each other.

The side face 69 of the chamber 67 is longer than the side face 49 of the chamber 47, and hence includes an exposed portion which does not face the side face 49 of the chamber 47. An elongated rectangular space 80 indicated by the dotted line in FIG. 3 is provided in front of the exposed portion of the side face 69 and alongside another side face 48 of the chamber 47, for accommodating a collection of pipes projecting from the chambers 47 and 67.

In other words, the units and machines of the polishing section 30 and the cleaning section 50 are positioned in the chambers 47, 67 in order to make the side faces 49, 69 different in length from each other for thereby providing the space 80.

Pipes 10 (10-1–10-11 in FIG. 5) extending outwardly from the polishing section 30 project horizontally from the side face 48 of the chamber 47 into the space 80, and pipes 20 (20-1–20-5 in FIG. 5) extending outwardly from the cleaning section 50 project horizontally from the exposed portion of the side face 69 of the chamber 67 into the space 80. That is, the pipes 10 and 20 are collected in the space 80.

The pipes 10 and 20 then extend vertically through holes defined in a floor 70 (see FIG. 6) into a machinery room 90 below the floor 70 of a clean room 200 which accommodates the polishing section 30 and the cleaning section 50. The machinery room 90 houses various machines 91.

Figure 5:
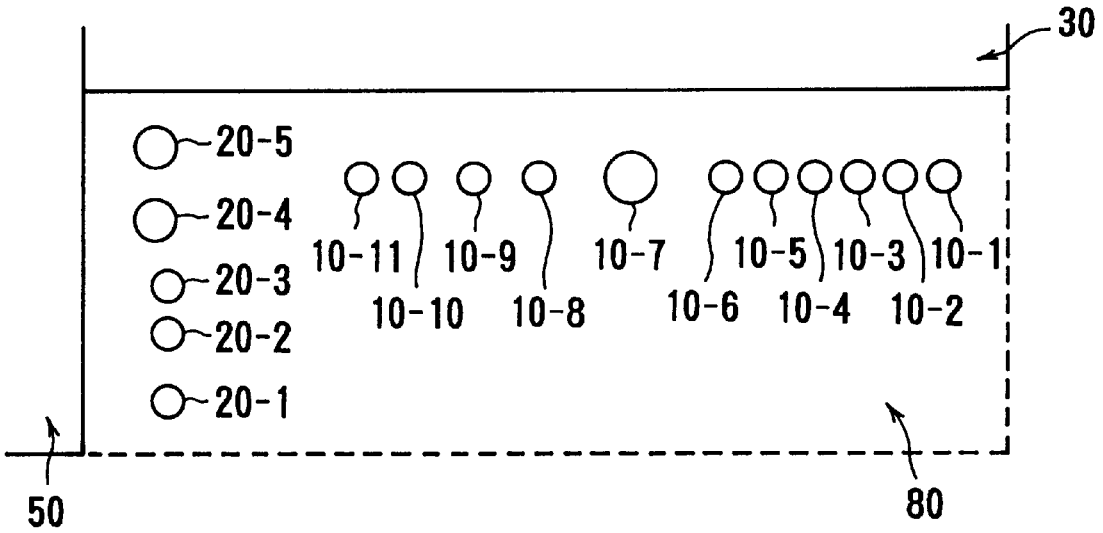
FIG. 5 is a schematic plan view showing an arrangement of pipes according to the second embodiment of the present invention.

FIG. 5 shows at an enlarged scale the pipes 10-1–10-11 and the pipes 20-1–20-5 which are positioned in the space 80 and extend vertically through the floor 70.

In FIG. 5, the pipes 10-2, 10-4 and 10-6 serve as inlets of abrasive liquid circulation pipes for supplying the abrasive liquid from the machines 91 to the polishing surface 34 of the turntable 33. The pipes 10-1, 10-3 and 10-5 serve as outlets of the abrasive liquid circulation pipes for returning the abrasive liquid which has not been used to the machines 91. The pipe 10-7 serves as an abrasive liquid drain pipe for draining the abrasive liquid which has been used on the abrasive surface 34 and also draining pure water. The pipe 10-8 serves as a pure water supply pipe for supplying pure water for the dressing process. The pipe 10-9 serves as a leakage liquid drain pipe for draining liquid which has leaked from the various units of the polishing section 30. The pipe 10-10 serves as an outlet of a cooling water circulation pipe for supplying cooling water to the turntable 33 or the like. The pipe 10-11 serves as an inlet of the cooling water circulation pipe.

The pipe 20-1 serves as a pure water supply pipe for supplying pure water to the primary and secondary cleaning devices 55, 57, the spinning drier 59 and the workpiece reversing device 61. The pipes 20-2, 20-3 serve as drain pipes for draining various liquid which has been used. The pipe 20-4 serves as an inlet of a cleaning liquid circulation pipe for supplying cleaning liquid to the primary and secondary cleaning devices 55, 57. The pipe 20-5 serves as an outlet of the cleaning liquid circulation pipe.

Figure 6:
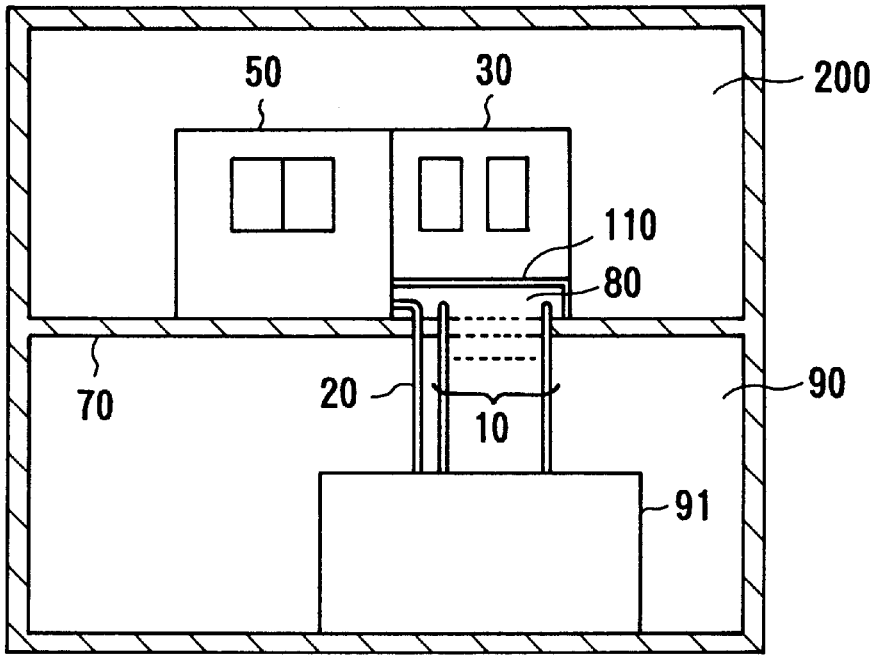
FIG. 6 is a schematic vertical cross-sectional view showing an arrangement of a polishing apparatus and a machinery room.
Figure 7:
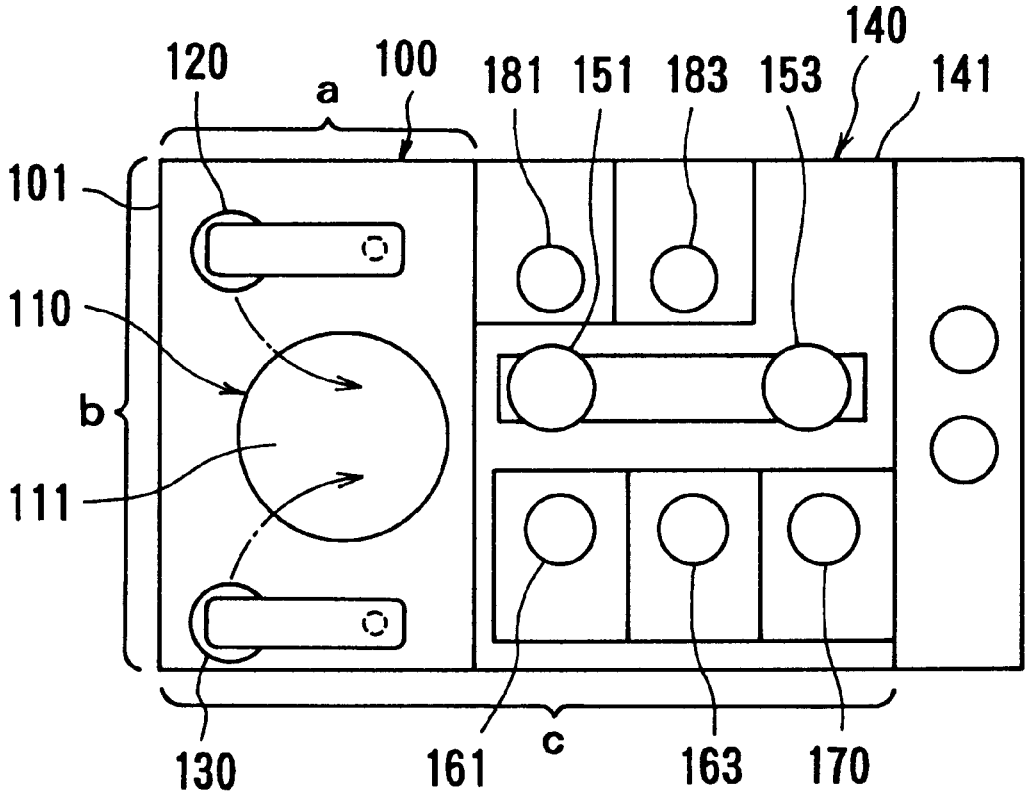
FIG. 7 is a schematic plan view of a conventional polishing apparatus.
Figure 8:
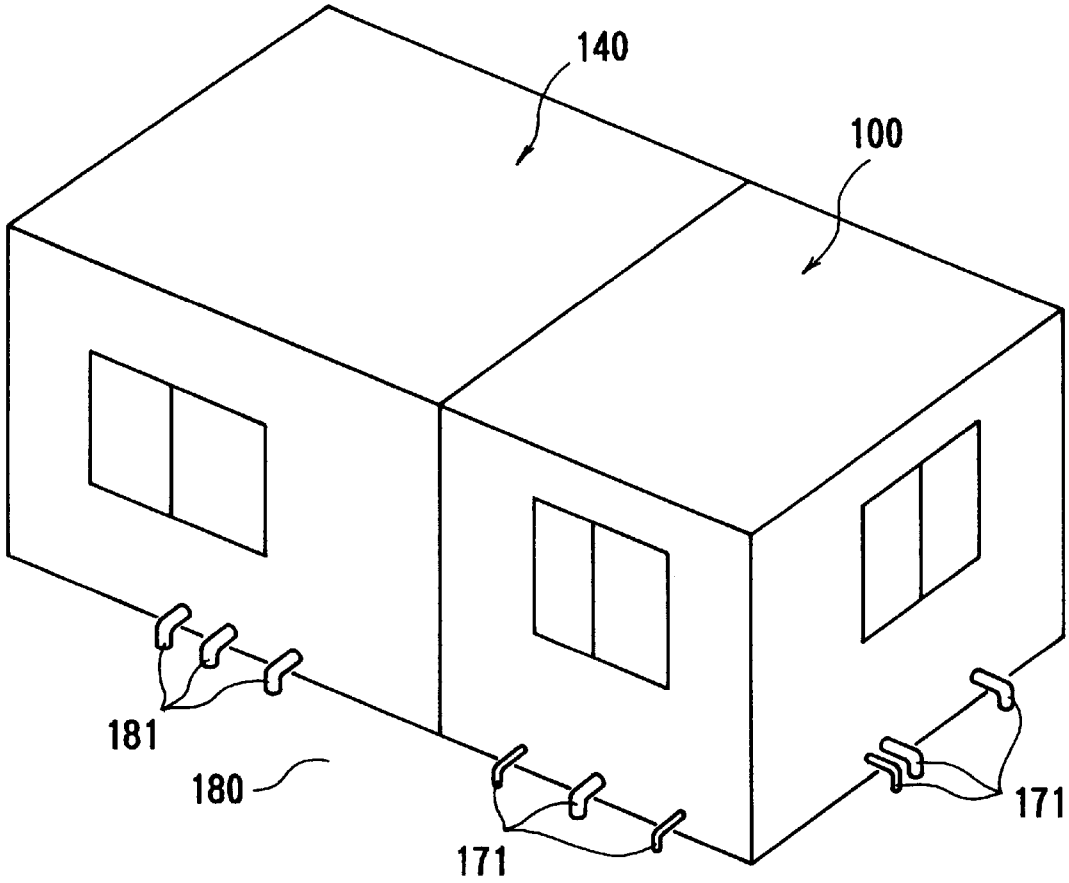
FIG. 8 is a perspective view showing an outward appearance of the conventional polishing apparatus shown in FIG. 7.

FIG. 6 shows an arrangement of the polishing apparatus and the machinery room 90. As shown in FIG. 6, the polishing apparatus is installed in the clean room 200. The machinery room 90 is disposed below the floor 70 on which the polishing apparatus is installed. The various machines 91 housed in the machinery room 90 include an abrasive liquid supply device for supplying and circulating the abrasive liquid to the polishing section 30, a waste liquid treatment device for treating waste liquid discharged from the polishing section 30 and the cleaning section 50, and a cooling water supply device for supplying the cooling water to the polishing section 30.

The pipes 10, 20 extending downwardly through the floor 70 into the machinery room 90 are connected to the machines 91 in the machinery room 90. The pipes 10, 20 which project from the polishing section 30 and the cleaning section 50 at the side faces 48, 69 of the chambers 47, 67 are collected in the space 80. These pipes 10, 20 do not project from other side faces of the polishing section 30 and the cleaning section 50, and hence maintenance of the polishing section 30 and the cleaning section 50 can be easily performed at those other side faces.

Since the space 80 is positioned at a recess jointly defined by the side faces 48, 69 of the chambers 47, 67, the pipes 10, 20 do not project into passages around the polishing section 30 and the cleaning section 50.

Figure 4:
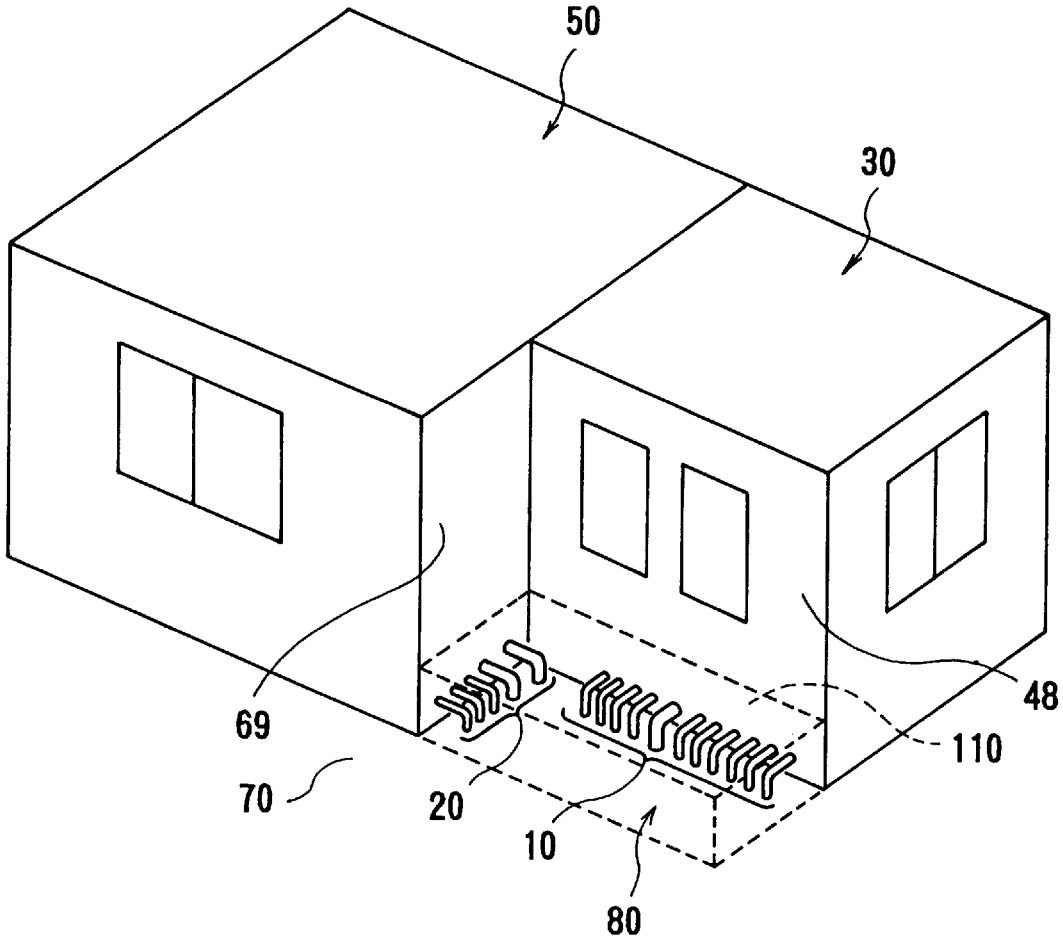
FIG. 4 is a perspective view showing an outward appearance of the polishing apparatus according to the second embodiment of the present invention.

As shown in FIGS. 4 and 6, the projecting pipes 10, 20 in the space 80 may be covered with a step-like plate 110. The step-like plate 110 thus mounted in position may be used as a footstep, thus providing a space thereabove as a free space available for various purposes, e.g., for maintenance of the polishing section 30. The step-like plate 110 is also effective to conceal the pipes 10, 20 from external view, thus providing a sightly appearance.

As is apparent from the above description, the second embodiment of the present invention offers the following advantages:

Since the pipes from the polishing section and the cleaning section are collected at a single location, maintenance for various devices in the polishing section and the cleaning section can be easily performed from other side faces where the pipes do not exist.

Since the pipes from the polishing section and the cleaning section are collected at a single location, the pipes do not present obstacles when the polishing apparatus is transported. Further, the through holes for inserting the pipes into the downstairs machinery room can be formed at a single location, and thus the operation of installation of the polishing apparatus can be easily carried out.

Since the space for collecting the pipes is provided at a recess jointly defined by the polishing section and the cleaning section, the pipes do not project into passages around the polishing section and the cleaning section, and hence do not obstruct operators from walking therearound.

In the case where the step-like plate is provided in the space for collecting the pipes, a space above the step-like plate can be utilized as a free space available for various purposes, and the step-like plate can conceal the pipes from external view to thus provide a sightly appearance.

In the above embodiment, although the polishing apparatus comprises a polishing section and a cleaning section housed in each chamber, the partition between two sections may be omitted. That is, the polishing section and the cleaning section may be housed in a common housing.

Although certain preferred embodiments of the present invention have been shown and described in detail, it should be understood that various changes and modifications may be made therein without departing from the scope of the appended claims.

What is claimed is:

1. A polishing apparatus for polishing a surface of a workpiece, said apparatus comprising:

a turntable having a polishing surface;

a top ring for holding a workpiece and for pressing the workpiece against said polishing surface of said turntable to polish the workpiece, said top ring being movable to a first maintenance position whereat maintenance can be performed thereon;

a dressing tool for dressing said polishing surface of said turntable, said dressing tool being movable to a second maintenance position whereat maintenance can be performed thereon;

a first chamber having a plurality of side faces including a first side face serving as a first maintenance face, said first side face comprising an outer wall of said polishing apparatus; and said turntable, said top ring and said dressing tool being located within said first chamber at relative positions such that said polishing surface of said turntable, said top ring when in said first maintenance position thereof and said dressing tool when in said second maintenance position thereof are positioned closely adjacent said first maintenance face, thereby enabling access for maintenance purposes from said first maintenance face to all of said polishing surface of said turntable, said top ring when in said first maintenance position thereof and said dressing tool when in said second maintenance position thereof.

2. An apparatus as claimed in claim 1, further comprising a second chamber having a plurality of side faces including a one side face serving as a second maintenance face and oriented to extend in the same direction as said first maintenance face, and a cleaning device for cleaning a workpiece that has been polished, said cleaning device being located within said second chamber at a position closely adjacent said second maintenance face, thereby enabling access for maintenance purposes from said second maintenance face to said cleaning device.

3. A polishing apparatus for polishing a surface of a workpiece, said apparatus comprising:

a polishing section for polishing a surface of a workpiece and housed in a first chamber having a first side face;

a cleaning section for cleaning a workpiece that has been polished, said cleaning section being housed in a second chamber having a second side face having a length greater than a length of said first side face;

said first chamber and said second chamber being positioned with said first side face and said second side face being adjoined and with a length portion of said second side face extending beyond said first side face and defining an exposed portion of said second side face;

said exposed portion of said second side face and another side face of said first chamber facing and defining a space located outwardly of said first and second chambers;

said polishing section having pipes extending from said another side face of said first chamber into said space; and said cleaning section having pipes extending from said exposed portion of said second side face into said space.

4. An apparatus as claimed in claim 3, further comprising a plate extending into said space and covering said pipes.

5. An apparatus as claimed in claim 3, further comprising a floor on which are mounted said polishing section and said cleaning section, and a machinery room below said floor and housing machinery devices, said pipes extending downwardly from said space through said floor and being connected to said machinery devices.

6. An apparatus as claimed in claim 3, wherein said another side face extends transverse to said first side face.

7. An apparatus as claimed in claim 3, wherein said first chamber has a further side face transverse to said first side face and spaced from said another side face, said second chamber has a further side face transverse to said second side face, and said further side face of said first chamber is aligned with said further side face of said second chamber.

8. A polishing apparatus for polishing a surface of a workpiece, said apparatus comprising:

a polishing section for polishing a surface of a workpiece, said polishing section comprising a turntable having a polishing surface and a top ring for holding a workpiece and for pressing the workpiece against said polishing surface of said turntable to polish the workpiece, said top ring being movable to a first maintenance position whereat maintenance can be performed thereon;

a cleaning section for cleaning a workpiece that has been polished; and said polishing section and said cleaning section having respective side faces that are oriented in the same direction and that enable an interior of said polishing section and an interior of said cleaning section to be accessed for purposes of performing maintenance on said turntable, said top ring, and said cleaning section, and said side faces comprising an outer wall of said polishing apparatus.

9. An apparatus as claimed in claim 8, further comprising:

a first chamber housing said polishing section and having a first side face;

a second chamber housing said cleaning section and having a second side face having a length greater than a length of said first side face;

said first chamber and said second chamber being positioned with said first side face and said second side face being adjoined and with a length portion of said second side face extending beyond said first side face and defining an exposed portion of said second side face;

said exposed portion of said second side face and another side face of said first chamber facing and defining a space located outwardly of said first and second chambers;

said polishing section having pipes extending from said another side face of said first chamber into said space; and said cleaning section having pipes extending from said exposed portion of said second side face into said space.

10. An apparatus as claimed in claim 9, further comprising a plate extending into said space and covering said pipes.

11. An apparatus as claimed in claim 9, further comprising a floor on which are mounted said polishing section and said cleaning section, and a machinery room below said floor and housing machinery devices, said pipes extending downwardly from said space through said floor and being connected to said machinery devices.

12. An apparatus as claimed in claim 9, wherein said another side face extends transverse to said first side face.

13. An apparatus as claimed in claim 11, wherein said side face of said polishing section comprises a further side face of said first chamber that is transverse to said first side face and spaced from said another side face, said side face of said cleaning section comprises a further side face of said second chamber that is transverse to said second side face, and said further side face of said first chamber is aligned with said further side face of said second chamber.

14. A polishing apparatus for polishing a surface of a workpiece, said apparatus comprising:

a housing having a plurality of sides;

a polishing section housed in said housing for polishing a surface of a workpiece, said polishing section comprising a turntable having a polishing surface and a top ring for holding a workpiece and for pressing the workpiece against said polishing surface of said turntable to polish the workpiece, said top ring being movable to a first maintenance position whereat maintenance can be performed thereon;

a cleaning section housed in said housing for cleaning a workpiece that has been polished; and a single said side of said housing providing access into an interior of said housing sufficient for achieving maintenance both of said turntable and said top ring of said polishing section and of said cleaning section.

* * * * *